United States Patent [19]

Formato

[11] 4,267,803

[45] May 19, 1981

[54] DISCHARGE DEVICE IGNITION SYSTEM

[75] Inventor: Richard A. Formato, 17 Red Coat Rd., Shrewsbury, Mass. 01545

[73] Assignees: Richard A. Formato, Shrewsbury, Mass.; Theodore P. Zoli, Jr., Glens Falls, N.Y.

[21] Appl. No.: 48,673

[22] Filed: Jun. 14, 1979

[51] Int. Cl.[3] ..... F02P 7/00

[52] U.S. Cl. ..... 123/146.5 A; 123/612; 123/613; 123/627

[58] Field of Search ..... 123/148 E, 146.5 A, 123/148 DK, 148 ND, 148 R; 200/19 R; 315/209 R, 209 M; 313/100, 97, 98

[56] References Cited

U.S. PATENT DOCUMENTS

| | | | |
|---|---|---|---|
| 2,436,905 | 3/1948 | Short | 315/210 |
| 3,071,730 | 1/1963 | Piepenburg | 315/209 M |
| 3,406,314 | 10/1968 | Parish | 123/148 E |
| 3,422,307 | 1/1969 | Langer | 313/100 |
| 3,505,563 | 4/1970 | Randall et al. | 315/209 |
| 3,595,212 | 7/1971 | Barnes | 123/148 E |
| 4,019,486 | 4/1977 | Siegle | 123/148 E |
| 4,047,513 | 9/1977 | Adams et al. | 123/148 E |
| 4,138,983 | 2/1979 | Espenschied | 123/148 E |
| 4,194,480 | 3/1980 | Rado | 123/148 E |

FOREIGN PATENT DOCUMENTS

| | | | |
|---|---|---|---|
| 2701964 | 7/1978 | Fed. Rep. of Germany | 123/148DS |

*Primary Examiner*—Charles J. Myhre
*Assistant Examiner*—Andrew M. Dolinar
*Attorney, Agent, or Firm*—Joseph S. Iandiorio

[57] ABSTRACT

An ignition system for a multi-cylinder engine having a distributor shaft for timing the ignition, a plurality of spark plugs and a means of producing a high voltage signal for firing the spark plugs, including: a discharge device interconnected between the means for producing a high voltage signal and each spark plug and incapable of conducting in response only to a high voltage signal; and means, operated by the distributor shaft, for selectively, sequentially energizing each discharge device to enable it to conduct and deliver the high voltage signal to the associated spark plug in time with engine operation.

38 Claims, 8 Drawing Figures

DISCHARGE DEVICE IGNITION SYSTEM

FIELD OF INVENTION

This invention relates to an improved ignition system and more particularly to such an improved ignition system in which the high voltage transmitted to the spark plugs is controlled through discharge devices.

BACKGROUND OF INVENTION

Conventional ignition systems employ mechanical breaker points or electronic circuitry driven by rotation of some part of the distributor, typically a distributor shaft, to properly time high voltage pulses which are generated by an ignition coil for firing the spark plugs. The high voltage output of the coil is usually fed through a central electrical contact in the distributor cap to a conductor mounted on a dielectric rotor on the distributor shaft. As the shaft rotates, operating the breaker points or the electronic circuitry connected to the ignition coil primary (low voltage) winding in time with piston travel, the electrical contact at the outer end of the rotor successively engages each of a set of electrical contacts mounted circumferentially on the distributor cap and connected through high voltage leads to each of the spark plugs. The cap electrical contacts and the rotor electrical contact thus constitute a rotating mechanical switching mechanism whose purpose it is to distribute the high voltage signal to each of the spark plugs in the proper time relationship to engine operation. These systems suffer from various shortcomings. The rotor and cap electrical contacts wear so that periodic replacement is required. Those same contacts are particularly vulnerable to water, moisture and other contaminants (such as carbon or other foreign substances), which can prevent starting or lead to poor engine performance, such as misfiring, rough idle and poor fuel economy. Attempts have been made to improve these sytems. In one design a signal rotary element produces a single switching signal which, through complicated electronic circuitry, simultaneously interrupts the ignition coil primary current and controls the high voltage separately applied to each spark plug through a gas tube which apparently conducts in response to a reduction of its breakdown voltage induced by a magnetic field (U.S. Pat. No. 4,019,486). In addition to being complex, this approach is energetically very inefficient, since it requires the generation of rather intense magnetic fields. As a consequence, certain of its components must apparently be rather large. In another design the high voltage is switched independently using a frequency matching scheme, but this approach is also rather complex and cumbersome. In addition, neither of these systems is readily adaptable to existing ignition systems. The magnetically switched system, for example, includes no provision for incorporating the centrifugal and vacuum spark advance mechanisms necessary for efficient engine operation.

SUMMARY OF INVENTION

It is an object of this invention to provide an improved, simple, compact ignition system which eliminates the high voltage contact elements in the high voltage secondary circuit, and yet provides sequential switching of the high voltage to successive ones of the spark plugs in a system not susceptible to the typical problems associated with contact wear, water/moisture and foreign substance contamination to which other ignition systems are susceptible.

It is a further object of this invention to provide such an improved ignition system which is relatively small, compact, inexpensive, easily adaptable for housing in distributor caps of conventional ignition systems, and easily retrofit onto existing conventional ignition systems in such a fashion that the centrifugal and vacuum spark advance mechanisms of conventional systems or of systems employing electronically controlled spark timing are retained.

It is a further object of this invention to provide such an improved ignition system which employs discharge devices to control firing voltage to the spark plugs by suitably introducing energy into the discharge device which produces seed ionization in the discharge device.

This invention features an improvement in ignition systems for multi-cylinder engines having a distributor shaft for timing the ignition, a plurality of spark plugs and means for producing a high voltage signal for firing the spark plugs. The invention includes a discharge device interconnected between the means for producing a high voltage pulse (signal) and each spark plug and incapable of electrical conduction in response only to the high voltage pulse. The invention also includes means, synchronized in its operation by the distributor shaft, by which each discharge device is periodically energized to become electrically conductive to a high voltage pulse, thereby selectively and sequentially delivering the high voltage pulse to the associated spark plug in the proper time relationship to engine operation. In a specific embodiment the discharge device may be energized by introducing energy in the form of a radiant signal or an intense electric field in order to produce seed ionization within the discharge device which results in electrical conduction upon the application of a concurrent high voltage pulse.

DISCLOSURE OF PREFERRED EMBODIMENT

Other objects, features and advantages will occur from the following description of a preferred embodiment and the accompanying drawings, in which.

Figure 1:
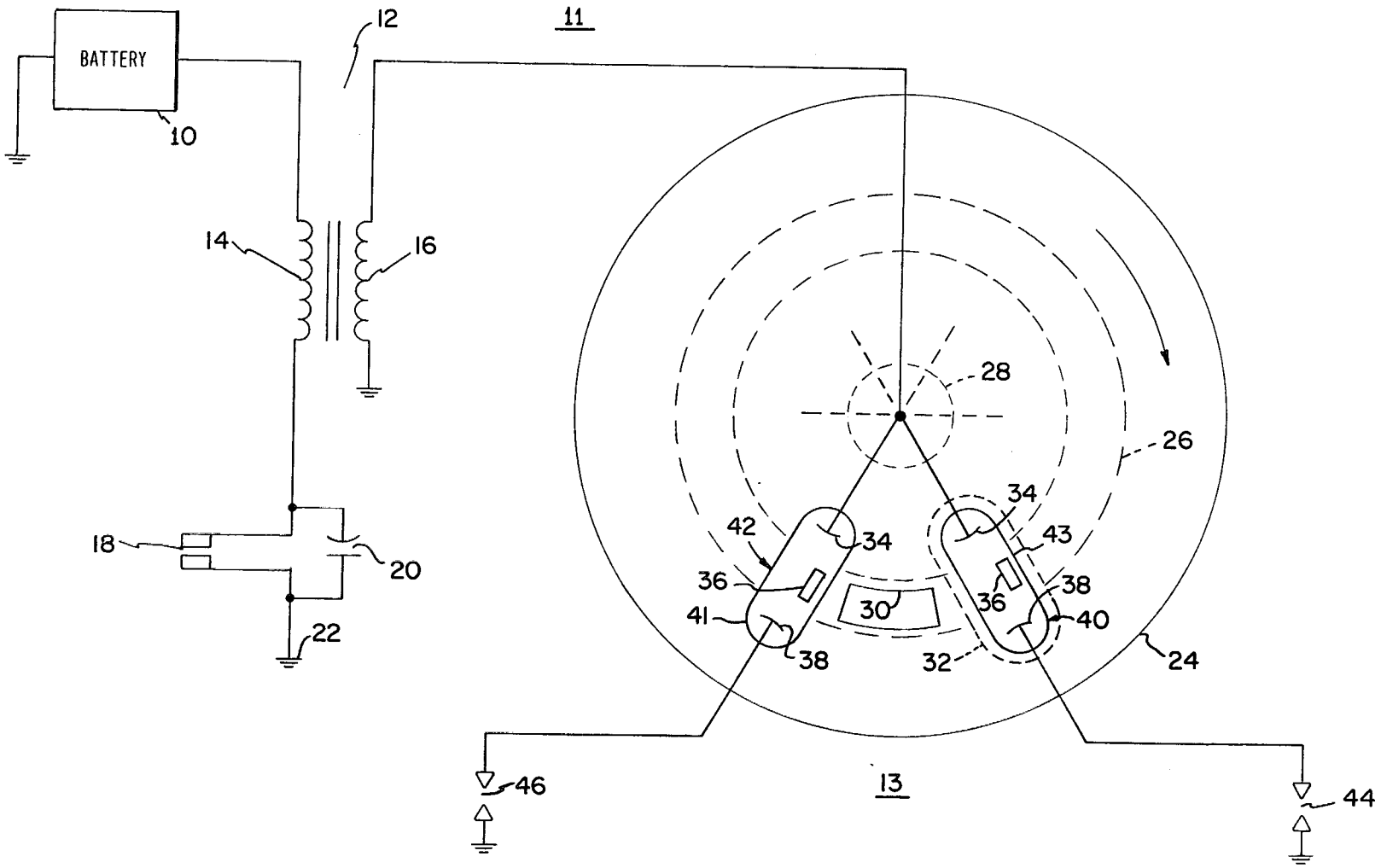
FIG. 1 is a schematic plan view of one embodiment of the discharge device ignition system according to this invention.

The invention may be accomplished in a conventional ignition system for a multi-cylinder engine in which a typical distributor shaft synchronizes operation of the ignition system through a set of mechanical breaker points or more sophisticated electronic switching equipment connected to the primary winding of the ignition coil. By shaft is meant any part used for timing purposes. A plurality of spark plugs are connected to the high voltage secondary of the ignition coil through discharge devices.

A discharge device consists of two high-voltage electrodes, one connected to the ignition coil high voltage winding and the other to a spark plug, which are contained in a hermetically sealed chamber. The chamber may contain a gas, or it may be evacuated. Alternatively, a single chamber, either evacuated or gas-filled, may contain a plurality of high-voltage electrode pairs, one set for each of the associated spark plugs; or, a single chamber may contain a single elctrode connected to the means for producing a high voltage signal and a plurality of electrodes spaced about it, one connected to each of the spark plugs. The discharge device is constructed according to well-known principles (References: (1) *Electrical Breakdown of Gases,* J. M. Meek and J. D. Craggs, Oxford University Press, 1953; (2) *Gaseous Conductors,* J. D. Cobine, Dover Pub., 1958) in such a manner that the application of a high voltage pulse of sufficient amplitude to fire the spark plugs is alone insufficient to cause electrical conduction through it. The discharge device is energized to become electrically conductive by periodically introducing energy in either the form of a radiant signal or an intense electric field which produces seed ionization within the discharge device and which allows it to become electrically conductive upon application of a concurrent high voltage pulse.

If the discharge device is radiantly triggered (that is, energized by the introduction of radiant energy), the mechanism of seed ionization production may be: the photoelectric liberation of free electrons from a suitable photoemissive material included in the discharge device chamber; or direct photoionization of a gas contained in the discharge device. Photoemissive materials may be introduced into the discharge device in bulk form, as dopants or alloys in the high voltage electrodes, or, under certain conditions, as vapors. Photoemissive material introduced in bulk form may be electrically connected to one or the other of the high voltage electrodes. Alternatively, a separate photoemissive element contained in the discharge device chamber may be electrically connected to ground through a large value resistor, typically several megohms, in order to prevent the accumulation of excess charge on the photoemissive element. Such photoemissive materials may be included in discharge devices that are gas-filled or evacuated. For gas-filled discharge devices, once seed ionization has been established, the application of a high voltage pulse from the ignition coil to the high voltage electrodes produces an electric field which accelerates free charged particles to very high kinetic energies. These highly energetic particles, in turn, collisionally interact with neutral gas molecules to produce a rapid increase in the ionization level within the discharge device (avalanche ionization), with the result that the discharge device becomes electrically conductive to the high voltage pulse. The discharge device chamber is considered evacuated when the charged particle mean free path for residual gas in the chamber is large compared to the electrode spacing between which a spark-like discharge is to occur. For an electrode spacing of 0.01 meter, for example, this condition is obtained at residual gas pressures of $10^{-6}$ mm of mercury or less for typical gaseous materials. For evacuated discharge devices, application of a high voltage pulse from the ignition coil again rapidly accelerates the charged particles which constitute the seed ionization. For example, an electron at rest acted upon by a uniform field of 100 kv/cm travels a distance of one centimeter in $10^{-10}$ seconds and achieves a velocity of about 0.2 the velocity of light. These highly energetic particles impact the high voltage electrodes collisionally liberating additional charged particles which then result in a spark-like discharge between the high voltage electrodes. In this manner, an evacuated discharge device is energized and becomes highly conductive between the high voltage electrodes.

If the discharge device is field triggered (that is, energized by the introduction of energy in the form of an intense electric field), the seed ionization may again be one of two types: for gas-filled discharge devices seed ionization is produced by local breakdown of the gas in the discharge device; for evacuated discharge devices seed ionization is produced by a spark-like discharge between triggering electrodes in the evacuated chamber. The field triggered discharge device may be constructed with a third triggering electrode contained in the discharge device chamber which is in close proximity to one of the high voltage electrodes. Since the electric field established between two conductors depends both on the potential difference between them, their geometry and spacing, the trigger electrode material, geometry and spacing may be chosen so that an intense electric field adequate to produce the required level of seed ionization results from the application of a low or intermediate voltage to the trigger electrodes. In this manner, a low or intermediate voltage signal selectively and sequentially applied to the discharge devices may be used to control the distribution to the spark plugs of the high voltage pulses generated by the ignition coil. The mechanisms by which the gas-filled and evacuated field triggered discharge devices become conductive between the high voltage electrodes are the same as those by which their radiantly triggered counterparts become conductive upon application of a high voltage pulse.

If the discharge device is radiantly triggered, it has associated with it a source of radiant energy, such as a light-emitting diode (LED), solid-state laster, flashtube, lamp or any other suitable radiant source which produces seed ionization within the discharge device either by directly photoionizing the gaseous contents of a gas-filled discharge device or by photoelectrically introducing free electrons from a photoemissive material included in the discharge device, which, in this latter case, may be either gas-filled or evacuated. The radiant source periodically energizes the discharge device by means whose operation is synchronized by the distributor shaft, and the radiant source may be either continuously operating or turned on and off (pulsed) in a suitable manner. If the seed ionization is produced by a radiant energy source, the envelope of the discharge device which encloses the discharge device chamber is constructed so that some suitable portion of its surface is transparent to radiant energy (electromagnetic radiation) at the operating wavelength of the radiant source so that the radiant trigger signal may be transmitted to the discharge device chamber. If necessary, each discharge device is radiatively shielded from the radiant trigger signals associated with each of the remaining discharge devices. Glass is a suitable material for transmitting radiant signals in the infrared and visible portions of the spectrum, while quartz is suitable for passing radiation in the ultraviolet region.

If the seed ionization in a discharge device, which may be either evacuated or gas-filled, is produced photoelectrically upon periodic application of a suitable radiant triggering signal, the discharge device chamber may contain a suitable photoemissive material introduced either in bulk form, as a dopant or alloy in the discharge device electrodes, or, under certain conditions, as a vapor. Radiant energy whose wavelength is below some threshold value which is determined by the chemical composition of the photoemissive material photoelectrically liberates free electrons from the material. The number of free electrons thus produced depends upon the intensity of the radiant signal, and their engergy upon the wavelength. The photon energy bears an inverse relationship to the wavelength of a radiant signal. Suitable photoemissive materials include, for example, cesium (Cs), rubidim (Rb) and strontium (Sr), whose photoelectric work functions are 1.9, 2.09, and 2.06 electronvolts, respectively. The corresponding threshold wavelengths for these materials are, respectively, 6534, 5940 and 6026 angstroms (approximately), all of which lie in the red-yellow portion of the visible spectrum. Alternatively, one of the photoemissive materials standardized by the EIA (Electronic Industries Association) according to spectral response might be employed. Representative examples include Ag—O—Cs (S-1 spectral response) and Cs—Sb (S-9 spectral response) whose wavelengths of maximum response are 8000 and 4800 angstroms, respectively, both in the visible region, and whose radiant responsivities at those wavelengths are 2.32 and 48.5 mA/W, respectively. Lime glass is a suitable window material for passing radiation of these wavelengths.

Typical of the radiant sources operating in this region of the spectrum are the following crystalline lasers: $LaF_3$ (1% $Pr^{3+}$ doping) at 5985 Å, $Y_2O_3$ (5% $Eu^{3+}$ doping) at 6113 Å, and $CaF_2$ ($Ho^{3+}$ doping) at 5512 Å and the following p-n junction LED's: SiC (4560 Å), GaP (5650 Å), ZnTe (6200 Å), $Zn(Se_xTe_{1-x})$ (6270 Å), $Cu_2Se$—ZnSe (4000–6300 Å), $Ga(As_{1-x}P_x)$ (5500–9000 Å), and CdTe–ZnTe (5600–6600 Å), and representative examples.

If a gas-filled discharge device is radiantly triggered by direct photoionization of its gaseous contents for the production of seed ionization, a radiant signal whose wavelength is below the threshold wavelength for direction photoionization of the gas is periodically applied to the discharge device by means synchronized in its operation by the distributor shaft. The threshold wavelength depends upon the chemical composition of the gas and the photoionization process which is employed (one-photon or two-step absorption, for example). Alkali vapors are typically ionized by ultraviolet photons; while the noble gases, molecular gases and other metallic vapors are typically ionized by ultraviolet or soft X-ray photons when single photon absorption is involved. Two-step photoionization involving an atom or molecule already in an excited energy state can occur at wavelengths well below the one-photon threshold wavelength. The intensity of the radiant trigger signal determines the number of ionized particles produced, while the energy of the charged particles is determined by the wavelength of the radiant energy.

If an evacuated discharge device is field triggered, that is, its seed ionization is produced by an intense electric field generated between triggering electrodes contained in the evacuated discharge device chamber, for example, the trigger electrode geometry (shape, spacing) and material are chosen so that a sufficiently intense electric field is generated from a low or intermediate voltage source to produce breakdown between the electrodes in vacuum (a spark-like discharge). For example, an evacuated field triggered discharge device may contain a needle-like triggering electrode in close proximity to the high voltage electrode which is connected to the spark plug. The needle-like geometry produces a local electric field intensification which is roughly proportional to the inverse of the radius of curvature of the tip for a hyperboloidal geometry. The magnitude of the electric field required to produce breakdown in vacuum depends critically on the electrode geometry, material and surface condition; it is typically several tens of thousands of volts per centimeter. For example, the uniform field vacuum breakdown voltages for glow-conditioned electrodes made of monel metal, aluminum and copper are, respectively, 60, 41 and 37 kilovolts for a 1 mm gap (Ref. 1, p. 124).

If a gas-filled discharge device is field triggered, that is its seed ionization is produced by an intense electric field generated between triggering electrodes contained in the gas filled discharge device chamber, the triggr electrode geometry (shape, spacing) are chosen so that a sufficiently intense electric field is generated from a low or intermediate voltage source to produce breakdown in the gaseous contents of the discharge device contained between the trigger electrodes. The electric field necessary to produce local gas breakdown which results in seed ionization in a gas-filled discharge device depends upon the chemical composition of the gas and its pressure. For example, if a gas-filled field triggered discharge device is to switch a 20,000 volt pulse from an ignition coil, it may be constructed with two high voltage electrodes which are disks separated by 3.0 cm in a gas-filled chamber containing nitrogen gas at 100 mm of Hg pressure at 18° C. A needle-like trigger electrode is included in the gas-filled chamber which is spaced apart from the high voltage electrode connected to the spark plug by approximately 0.2 mm. A trigger supply voltage of approximately 160 volts may then be used to generate a sufficiently intense electric field between the trigger electrodes to cause local gas breakdown (8 KV/cm for $N_2$ under these conditions) which constitutes the seed ionization within the discharge device. Concurrent application of a high voltage pulse from the ignition coil then induces avalanche ionization of the gas in the discharge device causing it to become electrically conductive between its high voltage electrodes and delivering the spark pulse to the associated spark plug.

FIG. 1 is a schematic plan view of one embodiment of the discharge device ignition system according to this invention. There is shown in FIG. 1 an ignition system 11 which includes a battery 10, and coil 12 having a high voltage secondary winding 16 and a low voltage primary winding 14 connected through mechanical breaker points 18 to ground 22. A transient suppressor capacitor 20 is connected in parallel with breaker points 18. Ignition system 11 also includes high voltage discharge device switching system 13 according to this invention. High voltage discharge device switching system 13 is adapted to fire six spark plugs in this illustrative six-cylinder engine example, only two of which spark plugs 44, 46 are shown for simplicity. Each of the spark plugs is connected in series with the high voltage winding 16 by a discharge device 40, 42. High voltage coil 12 may be replaced by any suitable means for developing properly timed high voltage pulses of sufficient intensity to fire the spark plugs. Similarly, breaker points 18 may be replaced by any suitable means synchronized by the distributor shaft for generating properly timed high voltage pulses by interrupting the current flowing in the ignition coil primary winding 14. Discharge devices 40, 42 in this illustrative example are radiantly triggered by radiant source 26 using the photoelectric production of seed ionization in the discharge device according to this invention. Discharge devices 40, 42 include high voltage electrodes 34, 38 electrically connected respectively to high voltage secondary winding 16 and the associated spark plug. Discharge device 42 switches the high voltage to spark plug 46, while device 40 controls the high voltage pulse transmitted to plug 44. Discharge devices 40, 42 also include photoemissive element 36, which may be electrically connected to one or the other of the high voltage electrodes 34, 38, or it may be connected to ground 22 through a large value resistor, typically several megohms. The discharge devices 40, 42 may have chambers 41, 43 filled with gas (an inert gas such as xenon or neon, for example), or they may be evacuated. Interposed between discharge devices 40, 42 and radiant source 26 is disk 24 containing an aperture 30, which transmits radiant energy at the operating wavelength of radiant source 26. Disk 24 is otherwise opaque to radiation from source 26. Aperture 30 may be simply an opening in disk 24, or it may be a window made of suitable material. Disk 24 is mounted on distributor shaft 28 and rotates with the shaft in time with piston travel. As disk 24 rotates beneath each discharge device 40, 42 the discharge devices are periodically illuminated by radiant source 26 which produces seed ionization within the discharge device by photoelectrically liberating free electrons from the photoemissive element 36. Application of a concurrent high voltage pulse from ignition coil winding 16 establishes an electric field between high voltage electrodes 34, 38 which accelerates the ionized particles to very high kinetic energies. These particles, in turn, either produce avalanche ionization in the case of a gas-filled discharge device or a spark-like discharge in the case of an evacuated discharge device according to the mechanisms described earlier which delivers the high voltage pulse from winding 16 to the associated spark plug. The angular extent of aperture 30 is chosen to accommodate the entire range of spark timing for the engine, thereby retaining the vacuum and centrifugal advance features of the distributor. Also shown in FIG. 1 is opaque baffle 32 which may be included to radiatively shield each discharge device 40, 42 so that each discharge device is energized only by the passage of aperture 30 beneath it. Radiant source 26 may be a distributed annular source as shown in this illustrative example, or it may consist of a plurality of separate radiant sources, one associated with each discharge device directly beneath it. The operating wavelength of radiant source 26 is chosen to photoelectrically liberate charged particles from target 36. For example, if target 36 is made of Ag—O—Cs, whose maximum response wavelength is 8000 angstroms, radiant source 26 may be a p-n junction LED made from $Ga(As_{1-x}P_x)$ which radiates in the 5500–9000 angstrom range.

Figure 2:
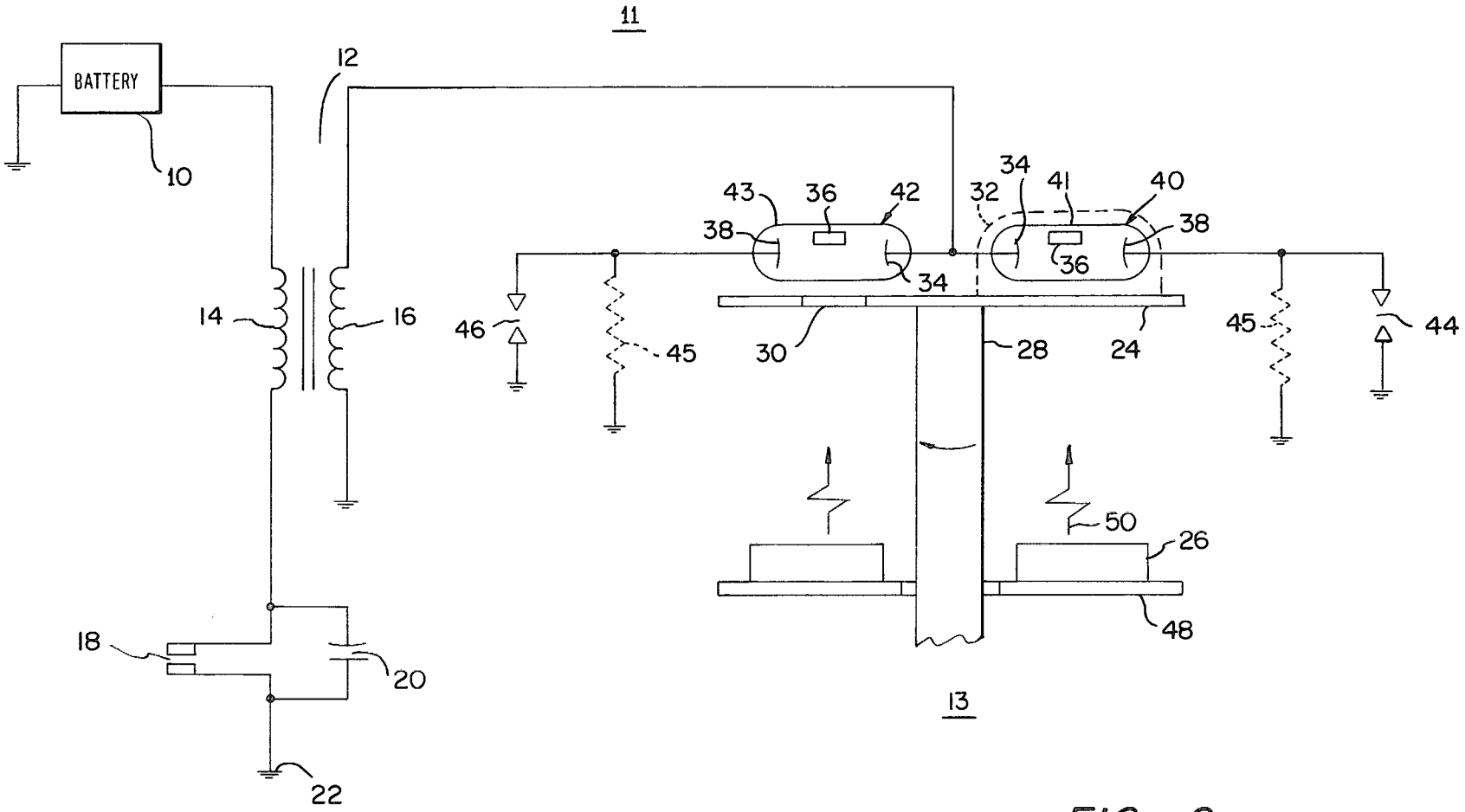
FIG. 2 is an elevational view similar to FIG. 1.

FIG. 2 provides an elevational view of the embodiment shown in FIG. 1. Disk 24 containing aperture 30 is mounted on and rotates with distributor shaft 28. Radiant source 26, whose radiant energy output is indicated by wavy line 50, is mounted on distributor base plate 48. Disk 24 is interposed between radiant source 26 and discharge devices 40, 42. Discharge devices 40, 42 may be mounted in the distributor cap (not shown) in which the spark plug leads are electrically connected. A large resistor 45, typically several hundred thousand ohms or larger, may be added in parallel with spark plugs 44, 46 in order to facilitate triggering of discharge devices 40, 42. The embodiment illustrated in FIGS. 1 and 2 is particularly useful, since it is simple and readily adapted to retrofit onto existing conventional distributors. In this application, radiant source 26 is mounted at the bottom of the distributor, and the conventional rotor is removed and replaced with disk 24. The conventional distributor cap is removed and replaced with a new cap containing discharge devices 40, 42 instead of electrical contacts. Contact towers for the insertion of spark plug high voltage leads and the ignition coil high voltage lead are included on the new cap containing the discharge devices. This particular embodiment is compact, inexpensive, and readily retrofit onto existing systems without loss of the existing centrifugal and vacuum spark advance mechanisms whether they are mechanical or electronic. A similar implementation may be achieved using field triggered discharge devices by replacing disk 24 with any suitable means whose operation is synchronized by rotation of the distributor shaft 28 which selectively and sequentially connects a low or intermediate voltage supply to the trigger electrode of each discharge device.

Figure 3:
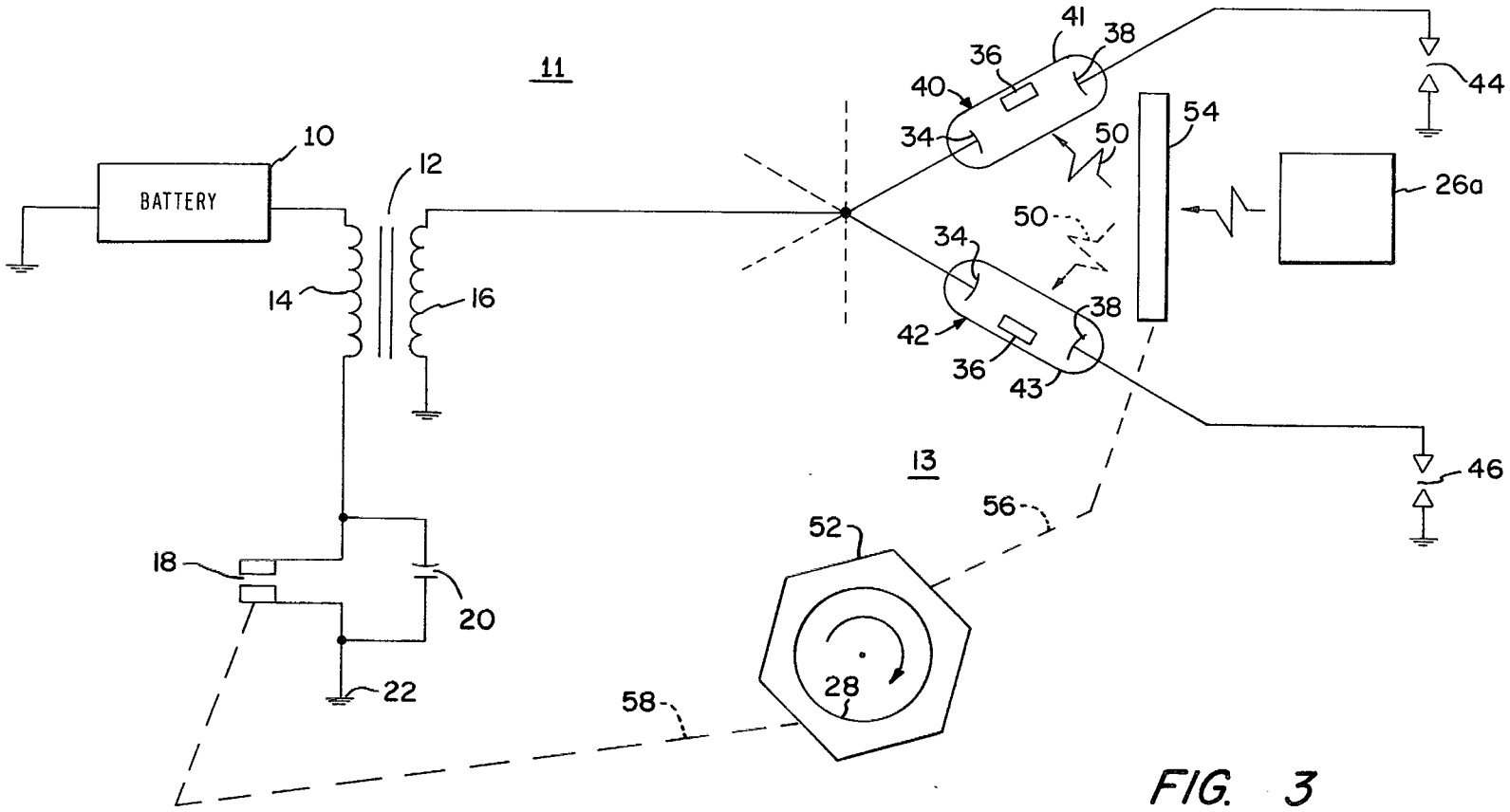
FIG. 3 is a diagram of an embodiment employing radiantly energized discharge devices and a continuously operating radiant source which selectively and sequentially energizes the discharge devices by means synchronized by the distributor shaft.

Another implementation of the system of FIGS. 1 and 2 is shown in FIG. 3. Distributor shaft 28 rotates in time with piston travel and includes a six-sided cam surface 52 which mechanically operates breaker points 18. The mechanical connection between cam surface 52 and points 18 is indicated by dashed line 58. Also shown in a continuously operating radiant source *26a* which provides a radiant triggering signal 50 for selective and sequential application to radiantly triggered discharge devices 40, 42. The radiant output of source *26a* is gated in time with engine operation by means 54, whose operation is synchronized by distributor shaft 28, indicated by dashed line 56. Means 54 is shown delivering a radiant trigger signal to discharge device 40, indicated by solid wavy line 50, while presently none is being transmitted to discharge device 42, indicated by broken wavy line 50. Means 54 may be achieved in a variety of forms, among them: a rotating opaque member containing an aperture, a mechanical or electromechanical shutter, a rotating member containing a radiant source, an array of electrooptical shutters, as representative examples.

Figure 4:
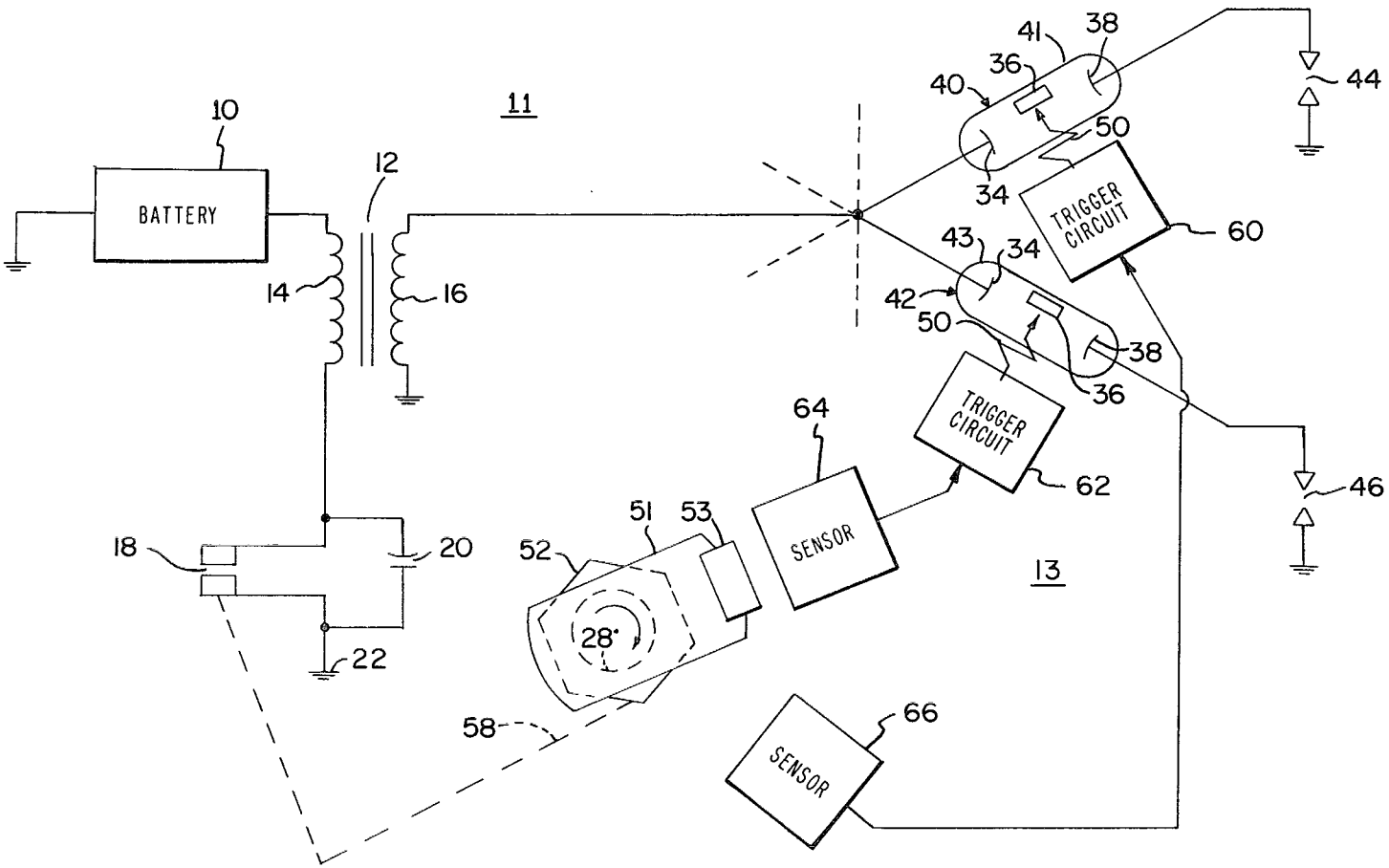
FIG. 4 is a diagram of an embodiment employing radiantly energized discharge devices and a pulsed triggering circuit associated with each discharge device which responds to a rotating member mounted on the distributor shaft.

Alternatively, FIG. 4 illustrates an embodiment in which each radiantly triggered discharge device has associated with it a separate radiant triggering circuit. Discharge device 40 is energized by radiant trigger circuit 60, for example, which responds to signals periodically received from sensor 66. Sensor 66, in turn, produces an output signal upon passage of rotating member 53 carried at the end of rotor 51 mounted on distributor shaft 28. Member 53, for example, may consist of a small permanent magnet mounted on rotor 5 which replaces the conventional electrical-contact rotor in a conventional ignition system. Sensors 64, 66 may be induction coils or Hall effect devices disposed circumferentially in a distributor cap which also contains trigger circuits 60, 62 and discharge devices 40, 42. As the magnet rotates past each sensor, an output signal is produced which actuates the associated trigger circuit to produce a pulse of radiant energy, as, for example, by firing an LED or solid-state laser, which in turn produces seed ionization to energize the associated discharge device. This implementation is also readily adaptable to existing conventional ignition systems, since it would require replacing only the existing cap and rotor and would retain the existing centrifugal and vacuum spark advance mechanisms.

Figure 5:
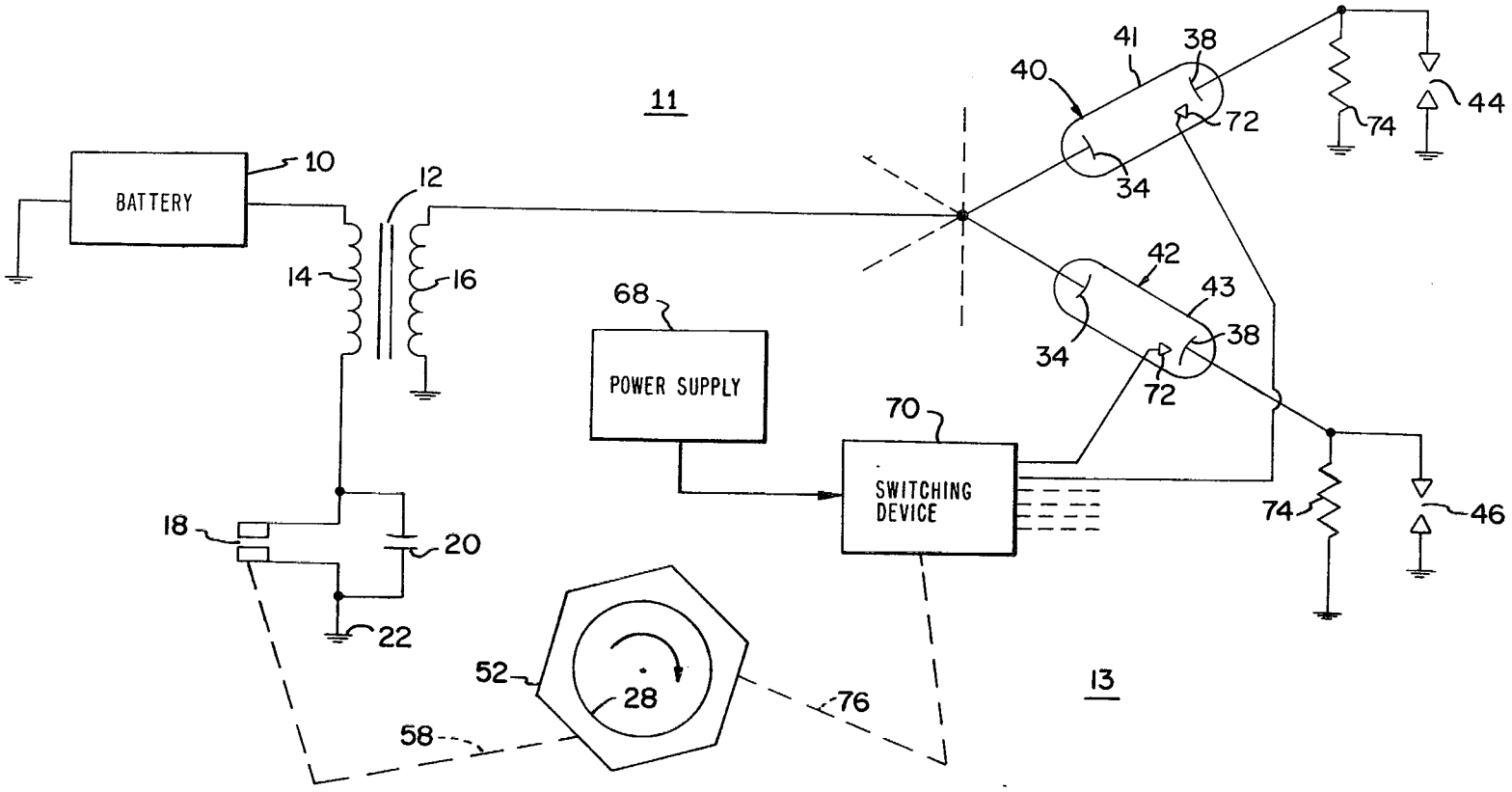
FIG. 5 is a diagram of an embodiment employing field energized discharge devices and a continuously operating power supply which selectively and sequentially energizes the discharge devices by means synchronized by the distributor shaft.

FIG. 5 illustrates an embodiment employing field triggered discharge devices in an implementation similar to that of FIG. 3. Discharge devices 40, 42 are energized by producing seed ionization between trigger electrode 72 and high voltage electrode 38 connected to the associated spark plug. A large value resistor 74, typically several hundred thousand ohms or larger, may be connected in parallel with the associated spark plug 44, 46 in order to complete the trigger electrode current path. Low or intermediate voltage power supply 68 is included to provide the triggering voltage necessary to operate trigger electrode 72. The output voltage of supply 68 is selectively and sequentially applied to each of the discharge device triggering electrodes 72 by switching mechanism 70 whose operation is synchronized in time with piston travel by the rotation of distributor shaft 28, indicated by dashed line 76. Switch 70 may be implemented in a variety of forms, among them a set of rotating low voltage electrical contacts, or an electronic switching circuit, as typical examples.

Figure 6:
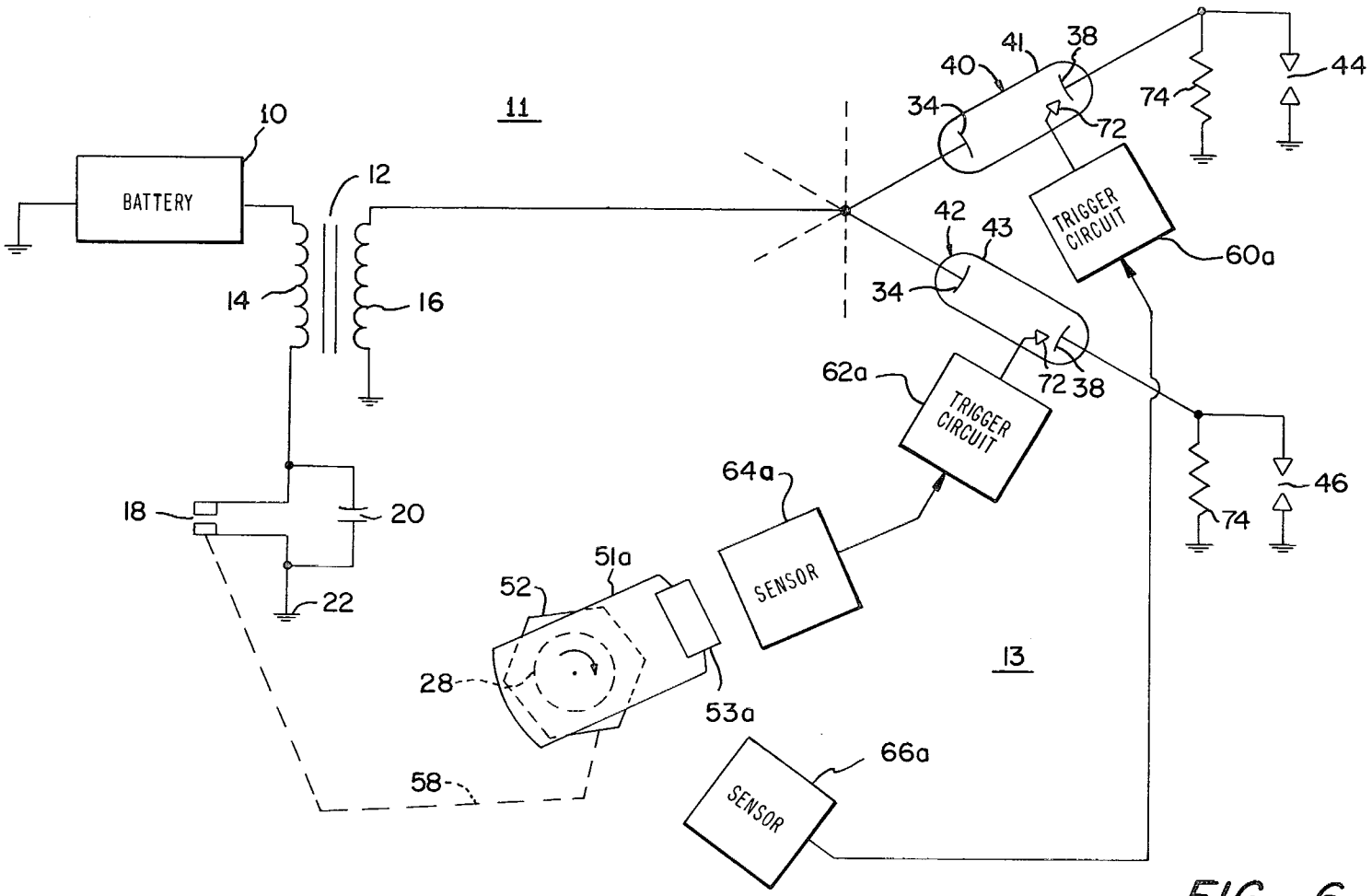
FIG. 6 is a diagram of an embodiment employing field energized discharge devices and a pulsed triggering circuit associated with each discharge device which responds to a rotating member mounted on the distributor shaft.

Alternatively, FIG. 6 illustrates an embodiment employing field triggered discharge devices in an implementation similar to that of FIG. 4. Each discharge device 40, 42 has associated with it a separate trigger circuit **60*a*, 62*a* which periodically produces a voltage pulse of sufficient amplitude to energize trigger electrode 72 contained in the discharge device to produce seed ionization. Each trigger circuit, in turn, responds to the output signal derived from sensors 64*a*, 66*a*. The sensors respond to the passage of member 53*a* carried on rotor 51*a* which is mounted on distributor shaft 28. This embodiment is also readily adapted to existing conventional ignition systems in a manner similar to that described in connection with FIG. 4**.

Figure 7:
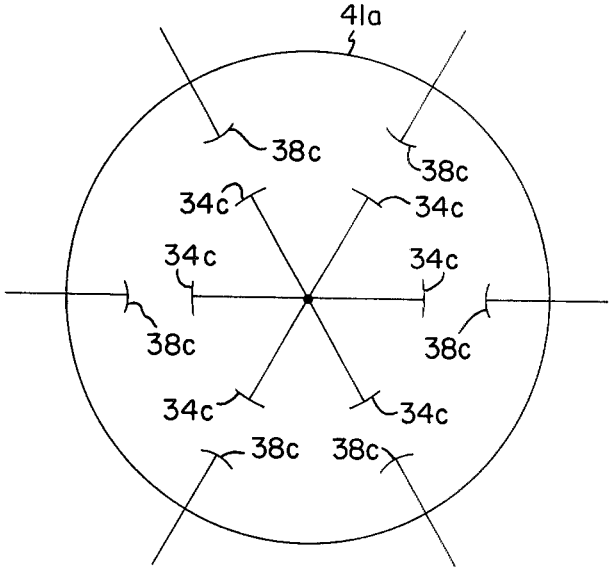
FIG. 7 is a diagram of a single chamber discharge device containing pairs of electrodes.
Figure 8:
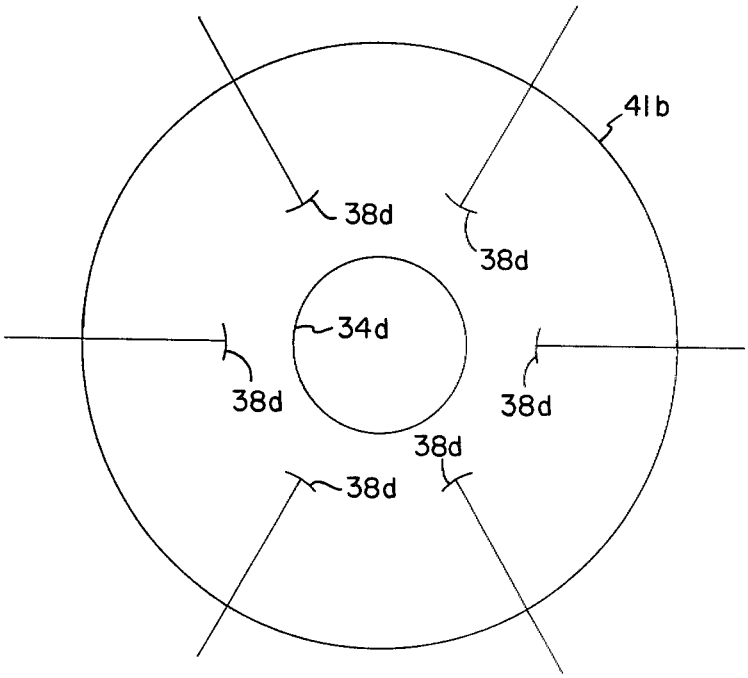
FIG. 8 is a diagram of a single chamber discharge device containing one input electrode and a plurality of associated electrodes.

Although thus far the discharge device associated with each spark plug has been illustrated as a pair of electrodes in an independent envelope, this is not a limitation in the invention. For example, a single chamber **41*a*, FIG. 7, either evacuated or gas-filled, may contain a plurality of high-voltage electrode pairs 34*c*, 38*c*, one set for each of the associated spark plugs; or, a single chamber 41*b*, FIG. 8, may contain a single electrode 34*d* connected to the means for producing a high voltage signal and a plurality of electrodes 38*d*** spaced about it, one connected to each of the spark plugs.

Other embodiments will occur to those skilled in the art and are within the following claims:

What is claimed is:

1. An ignition system for a multi-cylinder engine having a distributor shaft for timing the ignition, and a plurality of spark plugs, comprising:

means, responsive to said shaft for periodically producing a high voltage signal for firing the spark plugs;

a discharge device including a pair of spaced electrodes in a sealed chamber interconnected between the means for producing a high voltage signal and each spark plug and incapable of electrical conduction in response only to the high voltage signal;

a source of radiant energy for producing seed ionization within said discharge device; and means, responsive to said shaft and independent of said means for producing a high voltage signal for firing the spark plugs, for periodically selectively applying said radiant energy to each said discharge device to produce seed ionization therein and enable said discharge device to conduct a high voltage signal for firing the associated spark plug.

2. The system of claim 1 in which said means for selectively applying said radiant energy to said discharge devices includes a disk rotatable with said shaft and intermediate said source of radiant energy and discharge devices and having an aperture therein for selectively passing said radiant energy to said discharge devices.

3. The system of claim 1 in which said discharge device includes a photoemissive material for the production of said seed ionization within said discharge device.

4. The system of claim 1 in which said discharge device chamber is evacuated and contains a photoemissive material for the production of seed ionization within said discharge device.

5. The system of claim 1 in which said discharge device chamber is gas-filled and contains a photoemissive material for the production of seed ionization within said discharge device.

6. The system of claim 1 in which said discharge device chamber is gas-filled and in which seed ionization is produced by direct photoionization of the gas contained therein.

7. The system of claim 1 in which said discharge device includes a single chamber containing a plurality of high-voltage electrode sets, one set being associated with each of said spark plugs.

8. The system of claim 1 in which said discharge device includes a single chamber containing a single high-voltage electrode connected to said means for producing a high voltage signal and a plurality of high voltage electrodes spaced about it, one connected to each of said spark plugs.

9. An ignition system for a multi-cylinder engine having a distributor shaft for timing the ignition, and a plurality of spark plugs, comprising:

means, responsive to said shaft, for periodically producing a high voltage signal for firing the spark plugs;

a distributor cap housing containing a discharge device including a pair of spaced electrodes in a sealed chamber interconnected between the means for producing a high voltage signal and each spark plug and incapable of conducting in response only to the high voltage signal;

a source of radiant energy for producing seed ionization within said discharge device; and means, responsive to said shaft and independent of said means for producing a high voltage signal for firing the spark plugs, for periodically selectively applying said radiant energy to each said discharge device to produce seed ionization therein and enable said discharge device to conduct a high voltage signal for firing the associated spark plug.

10. The system of claim 9 in which said means for selectively applying said radiant energy to said discharge device includes a disk rotatable with said shaft and intermediate said source of radiant energy and discharge devices and having an aperture therein for selectively passing said radiant energy to said discharge devices.

11. The system of claim 9 in which said discharge device includes a photoemissive material for the production of said seed ionization within said discharge device.

12. The system of claim 9 in which said discharge device chamber is evacuated and contains a photoemissive material for the production of seed ionization within said discharge device.

13. The system of claim 9 in which said discharge device chamber is gas-filled and contains a photoemissive material for the production of seed ionization within said discharge device.

14. The system of claim 9 in which said discharge device chamber is gas-filled and in which seed ionization is produced by direct photoionization of the gas contained therein.

15. The system of claim 9 in which said discharge device includes a single chamber containing a plurality of high-voltage electrode sets, one set being associated with each of said spark plugs.

16. The system of claim 9 in which said discharge device includes a single chamber containing a single high-voltage electrode connected to said means for producing a high voltage signal and a plurality of high voltage electrodes spaced about it, one connected to each of said spark plugs.

17. An ignition system for a multi-cylinder engine having a distributor shaft for timing the ignition, and a plurality of spark plugs, comprising:

a first member, rotatable with said shaft;

a second member, independent of said first member and rotatable with said shaft;

first means, responsive to said first member, for periodically producing a high voltage signal for firing the spark plugs;

a discharge device including a pair of spaced electrodes in a sealed chamber interconnected between the means for producing a high voltage signal and each spark plug and incapable of electrical conduction in response only to the high voltage signal;

a source of energy including an electric field generating device for producing seed ionization within said discharge device, and a source of electric potential for operating said electric field generating device to produce seed ionization within said discharge device; and second means, responsive to said second member and independent of said first means, for selectively operating said electric field generating device to produce seed ionization within said discharge device and enable said discharge device to conduct a high voltage signal for firing the associated spark plug.

18. The system of claim 17 in which said electric field generating device is a set of electrodes in relatively close proximity and contained within said discharge device.

19. The system of claim 17 in which said chamber is evacuated chamber.

20. The system of claim 17 in which said chamber is gas-filled.

21. The system of claim 18 in which said device chamber is evacuated.

22. The system of claim 18 in which said chamber is gas-filled.

23. The system of claim 17 in which said discharge device includes a single chamber containing a plurality of high voltage electrode sets, one set being associated with each of said spark plugs.

24. The system of claim 17 in which said discharge device includes a single chamber containing a single high-voltage electrode connected to said means for producing a high voltage signal and a plurality of high voltage electrodes spaced about it, one connected to each of said spark plugs.

25. An ignition system for a multi-cylinder engine having a distributor shaft for timing the ignition, and a plurality of spark plugs, comprising:

a first member, rotatable with said shaft;

a second member, independent of said first member and rotatable with said shaft;

first means, responsive to said first member, for periodically producing a high voltage signal for firing the spark plugs;

a distributor cap housing containing a discharge device including a pair of spaced electrodes in a sealed chamber interconnected between the means for producing a high voltage signal and each spark plug and incapable of conducting in response only to the high voltage signal;

a source of energy including an electric field generating device for producing seed ionization within said discharge device, and a source of electric potential for operating said electric field generating device to produce seed ionization within said discharge device; and second means, responsive to said second member and independent of said first means, for selectively operating said electric field generating device to produce seed ionization within said discharge device and enable said discharge device to conduct a high voltage signal for firing the associated spark plug.

26. The system of claim 25 in which said electric field generating device is a set of electrodes in relatively close proximity and contained within said discharge device.

27. The system of claim 25 in which said chamber is evacuated.

28. The system of claim 25 in which said chamber is gas-filled.

29. The system of claim 26 in which said device chamber is evacuated.

30. The system of claim 26 in which said chamber is gas-filled.

31. The system of claim 26 in which said discharge device includes a single chamber containing a plurality of high voltage electrode sets, one set being associated with each of said spark plugs.

32. The system of claim 25 in which said discharge device includes a single chamber, containing a single high-voltage electrode connected to said means for producing a high voltage signal and a plurality of high voltage electrodes spaced about it, one connected to each of said spark plugs.

33. An ignition system for a multi-cylinder engine having a distributor shaft for timing the ignition, and a plurality of spark plugs, comprising:

a first member, rotatable with said shaft;

a second member, independent of said first member and rotatable with said shaft;

first means, responsive to said first member, for periodically producing a high voltage signal for firing the spark plugs;

a discharge device including a pair of spaced electrodes in a sealed chamber interconnected between the means for producing a high voltage signal and each spark plug and incapable of conducting in response only to the high voltage signal;

a trigger circuit associated with each said discharge device for producing seed ionization within said discharge device;

a sensing device which periodically produces a signal for actuating said trigger circuit; and second means, responsive to said second member and independent of said first means, for producing a signal in said sensing device, independent of said high voltage signal for firing said spark plugs, to periodically actuate said trigger circuit to produce seed ionization in said discharge device and enable said discharge device to conduct and deliver said high voltage signal to its associated spark plug.

34. The system of claim 33 in which said trigger circuit includes an electric field trigger device for producing seed ionization in said discharge device.

35. An ignition system for a multi-cylinder engine having a distributor shaft for timing the ignition, and a plurality of spark plugs, comprising:

a first member, rotatable with said shaft;

a second member, independent of said first member and rotatable with said shaft;

means responsive to said first member, for periodically producing a high voltage signal for firing the spark plugs;

a discharge device including a pair of spaced electrodes in a sealed chamber interconnected between the means for producing a high voltage signal and each spark plug and incapable of conducting in response only to the high voltage signal;

a source of energy for producing seed ionization within said discharge device; and means, responsive to said second member and independent of said means for producing a high voltage signal for firing the spark plugs, for periodically selectively applying said energy to each said discharge device to produce seed ionization therein and enable said discharge device to conduct a high voltage signal for firing the associated spark plug.

36. An ignition system for a multi-cylinder engine having a distributor shaft for timing the ignition, and a plurality of spark plugs, and a means for producing a high voltage signal for firing the spark plugs, comprising:

a discharge device interconnected between the means for producing a high voltage signal and each spark plug and incapable of conducting in response only to the high voltage signal; said discharge device including a single chamber containing a plurality of high voltage electrode sets, one set being associated with each of said spark plugs;

at least one trigger circuit associated with said discharge device for producing seed ionization within said discharge device;

a sensing device which periodically produces a signal for actuating said trigger circuit; and a rotating member mounted on said shaft for periodically producing a signal in said sensing device upon passing in close proximity to said sensing device for periodically actuating said trigger circuit which periodically produces seed ionization in said discharge device to enable said discharge device to conduct and deliver the high voltage signal to its associated spark plug.

37. An ignition system for a multi-cylinder engine having a distributor shaft for timing the ignition, and a plurality of spark plugs, and a means for producing a high voltage signal for firing the spark plugs, comprising:

a discharge device interconnected between the means for producing a high voltage signal and each spark plug and incapable of conducting in response only to the high voltage signal; said discharge device including a single chamber containing a single high-voltage electrode connected to said means for producing a high voltage signal and a plurality of high voltage electrodes spaced about it, one connected to each of said spark plugs;

at least one trigger circuit associated with said discharge device for producing seed ionization within said discharge device;

a sensing device which periodically produces a signal for actuating said trigger circuit; and a rotating member mounted on said shaft for periodically producing a signal in said sensing device upon passing in close proximity to said sensing device for periodically actuating said trigger circuit which periodically produces seed ionization in said discharge device to enable said discharge device to conduct and deliver the high voltage signal to its associated spark plug.

38. An ignition system for a multi-cylinder engine having a distributor shaft for timing the ignition, and a plurality of spark plugs, comprising:

first means, responsive to said shaft, for periodically producing a high voltage signal for firing the spark plugs;

a discharge device including a pair of spaced electrodes in a sealed chamber interconnected between the means for producing a high voltage signal and each spark plug incapable of conducting in response only to the high voltage signal;

a trigger circuit including a radiant trigger device associated with each said discharge device for producing seed ionization within said discharge device;

a sensing device which periodically produces a signal for actuating said trigger circuit; and second means, responsive to said shaft and independent of said first means, for producing a signal in said sensing device, independent of said high voltage signal for firing said spark plugs, to periodically actuate said trigger circuit to produce seed ionization in said discharge device and enable said discharge device to conduct and deliver said high voltage signal to its associated spark plug.

* * * * *